US009376644B2

(12) United States Patent
Endo et al.

(10) Patent No.: US 9,376,644 B2
(45) Date of Patent: Jun. 28, 2016

(54) LUBRICANT COMPOSITION

(71) Applicant: KYODO YUSHI CO., LTD., Fujisawa-shi, Kanagawa (JP)

(72) Inventors: Toshiaki Endo, Fujisawa (JP); Da Ming Dong, Fujisawa (CN); Yutaka Imai, Fujisawa (JP)

(73) Assignee: KYODO YUSHI CO., LTD., Fujisawa (JP)

( * ) Notice: Subject to any disclaimer, the term of this patent is extended or adjusted under 35 U.S.C. 154(b) by 0 days.

(21) Appl. No.: 14/312,199

(22) Filed: Jun. 23, 2014

(65) Prior Publication Data

US 2014/0303055 A1 Oct. 9, 2014

Related U.S. Application Data

(63) Continuation of application No. 12/240,087, filed on Sep. 29, 2008, now abandoned, which is a continuation of application No. PCT/JP2007/056574, filed on Mar. 28, 2007.

(30) Foreign Application Priority Data

Mar. 29, 2006 (JP) ..... 2006-091243

(51) Int. Cl.

| | |
|---|---|
| ***C10M 135/10*** | (2006.01) |
| ***C10M 159/24*** | (2006.01) |
| ***C10M 135/18*** | (2006.01) |
| ***C10M 137/10*** | (2006.01) |

(52) U.S. Cl.

CPC ..... *C10M 135/10* (2013.01); *C10M 135/18* (2013.01); *C10M 137/10* (2013.01); *C10M 159/24* (2013.01); *C10M 2203/1006* (2013.01); *C10M 2205/0285* (2013.01); *C10M 2207/0406* (2013.01); *C10M 2207/122* (2013.01); *C10M 2207/126* (2013.01); *C10M 2207/283* (2013.01); *C10M 2215/1026* (2013.01); *C10M 2219/044* (2013.01); *C10M 2219/046* (2013.01); *C10M 2219/066* (2013.01); *C10M 2219/068* (2013.01); *C10M 2223/045* (2013.01); *C10N 2230/02* (2013.01); *C10N 2230/06* (2013.01); *C10N 2230/12* (2013.01); *C10N 2240/02* (2013.01); *C10N 2240/04* (2013.01); *C10N 2250/10* (2013.01)

(58) Field of Classification Search

CPC ..... C10M 135/10; C10M 135/18; C10M 137/10; C10M 159/24; C10M 2203/1006; C10M 2205/0285; C10M 2207/0406; C10M 2207/122; C10M 2207/126; C10M 2207/283; C10M 2215/1026; C10M 2219/044; C10M 2219/046; C10M 2219/066; C10M 2219/068; C10M 2223/045; C10N 2230/02; C10N 2230/06; C10N 2230/12; C10N 2240/02; C10N 2240/04; C10N 2250/10

USPC ..... 508/363, 390

See application file for complete search history.

(56) References Cited

U.S. PATENT DOCUMENTS

| | | | | |
|---|---|---|---|---|
| 2,764,548 | A * | 9/1956 | King et al. | C07C 309/37 252/389.52 |
| 3,036,969 | A * | 5/1962 | Wilson et al. | 508/374 |
| 3,763,042 | A * | 10/1973 | Gannon | C10M 5/00 252/389.52 |
| 3,857,789 | A * | 12/1974 | Krupin | C10M 1/08 508/413 |
| 4,210,541 | A * | 7/1980 | Mann | 508/286 |
| 4,737,299 | A * | 4/1988 | Grasshoff et al. | 508/158 |
| 4,857,215 | A * | 8/1989 | Wong | 508/183 |
| 5,301,923 | A | 4/1994 | Asao et al. | |
| 6,063,740 | A * | 5/2000 | Kinoshita et al. | 508/364 |
| 6,329,328 | B1 | 12/2001 | Koganei et al. | |
| 6,432,888 | B1 | 8/2002 | Komiya et al. | |
| 2005/0003970 | A1 | 1/2005 | Ohmura et al. | |
| 2005/0009713 | A1 | 1/2005 | Kohara et al. | |
| 2006/0252655 | A1* | 11/2006 | Iso et al. | 508/154 |
| 2006/0281639 | A1* | 12/2006 | Taniguchi et al. | 508/168 |
| 2009/0003742 | A1 | 1/2009 | Nakatani et al. | |
| 2011/0306529 | A1* | 12/2011 | Schober | C10M 161/00 508/273 |

FOREIGN PATENT DOCUMENTS

| | | |
|---|---|---|
| EP | 1 847 586 | 10/2007 |
| JP | 3-210394 | 9/1991 |
| JP | 3-250094 | 11/1991 |
| JP | 5-263091 | 10/1993 |
| JP | 2002-121577 | 4/2002 |
| JP | 2002-130301 | 5/2002 |

(Continued)

OTHER PUBLICATIONS

International Search Report for PCT/JP2007/056574, mailed Jul. 3, 2007.

(Continued)

*Primary Examiner* — James Goloboy

(74) *Attorney, Agent, or Firm* — Nixon & Vanderhye P.C.

(57) ABSTRACT

The lubricant composition of this invention comprises a base oil and an additive, which is at least one selected from the group consisting of an organic sulfonate, a carboxylate, a thiocarbamate and a thiophosphoric acid ester salt. The lubricant composition can effectively suppress hydrogen embrittlement-caused flaking of an element, such as a rolling bearing, a sliding bearing, a gear, a ball thread, a linear guide, a linear bearing, a cam and various joints in a high concentration hydrogen environment. The invention provides also a rolling bearing, a sliding bearing, a gear, a ball thread, a linear guide, a linear bearing, a cam and various joints using the lubricant composition.

8 Claims, No Drawings

(56) References Cited

FOREIGN PATENT DOCUMENTS

| | | |
|---|---|---|
| JP | 2002-250351 | 9/2002 |
| JP | 2003-106338 | 9/2003 |
| JP | 2004-125165 | 4/2004 |
| JP | 2007-023105 | 1/2007 |
| JP | 2007-039572 | 2/2007 |
| JP | 2007-040446 | 2/2007 |
| JP | 2007-045994 | 2/2007 |
| JP | 2007-046753 | 2/2007 |
| JP | 2007-056906 | 3/2007 |
| JP | 2007-059091 | 3/2007 |
| JP | 2007-064442 | 3/2007 |
| JP | 2007-064443 | 3/2007 |
| JP | 2007-064454 | 3/2007 |
| JP | 2007-064456 | 3/2007 |
| WO | 2006078035 | 7/2006 |
| WO | 2006/112502 | 10/2006 |

OTHER PUBLICATIONS

Written Opinion of the International Searching Authority for PCT/JP2007/056574, mailed Jul. 3, 2007.

European Search Report issued for European Patent Application No. 07740012.5-2104/2003187, dated Dec. 27, 2010.

Japanese Office Action issued for Japanese Patent Application No. 2006-091243, dated Sep. 20, 2011.

* cited by examiner

LUBRICANT COMPOSITION

CROSS-REFERENCE TO RELATED APPLICATION

This application is continuation of U.S. patent application Ser. No. 12/240,087, filed Sep. 29, 2008, which is a continuation of International Application No. PCT/JP2007/056574, filed 28 Mar. 2007, which claims priority to Japanese Application No. 2006-091243, filed 29 Mar. 2006, the entire contents of each of which are incorporated herein by reference.

TECHNICAL FIELD

The present invention relates to a lubricant composition suitable for suppressing hydrogen embrittlement-caused flaking of an element to be used in a hydrogen existing environment. More specifically, the present invention relates to a lubricant composition suitable for suppressing hydrogen embrittlement-caused flaking of an element, such as a rolling bearing, a sliding bearing, a gear, a ball thread, a linear guide, a linear bearing, a cam or various joints, to be used in a hydrogen existing environment such as in a fuel cell-related device, a petroleum refinery-related device, such as a heavy oil hydrocracking apparatus, a hydrodesulfurization apparatus and a hydroforming apparatus, a device related to a hydrogenation apparatus for chemicals, etc., a nuclear power generator-related device, a hydrogen filling station for a fuel cell car and hydrogen infrastructures.

BACKGROUND ART

Technologies using hydrogen as an energy source have been recently remarkably developed as seen in the growth of the fuel cell. In this field, countermeasures against hydrogen have been long investigated with respect to materials per se for a storage container or piping in connection with a high pressure hydrogen storage technology. The negative effect of hydrogen on a metal material has been long studied in the field of corrosion. For example, hydrogen gas generated by a cathode reaction in a corrosive solution is adsorbed on the tip of a stress concentrated source, such as a defect, an inclusion and a deposit, or penetrates and accumulates in a material near the defect embrittling the area, so that a crack propagates in an element leading to destruction. Recently the problem of the hydrogen embrittlement of a metal material has drawn special attention, namely hydrogen penetrates into a metal material, such as steel, to lower the ductility of the metal material. Progress of the hydrogen embrittlement may bring a serious consequence such as fracture of the metal material. Such fracture of a metal material due to the hydrogen embrittlement is called as a delayed fracture phenomenon. The delayed fracture is also called as static fatigue, since a sudden brittle fracture can break out in a high strength element placed under a static tensile stress for a certain period of time. It is believed that such delayed fracture of a high strength element is caused by hydrogen penetrated into the element at the fabrication stage or from the environment during the usage. Since hydrogen penetrates easily to a metal element having higher concentration of atomic vacancy induced by plastic deformation, a fracture, namely hydrogen embrittlement occurs concentratively in the vicinity of tensile stress concentrated area, such as an area with a screw or a corrosion pit. The occluded hydrogen in a metal, especially steel, has generally little effect on the yield strength or the tensile strength, but is of the nature of deteriorating the ductility and tenacity. Therefore, the higher strength a metal element has, the higher susceptibility to the hydrogen embrittlement the element has, and therefore especially the high strength steel needs close attention to hydrogen.

There has been little research or investigation on the hydrogen embrittlement from the tribological viewpoint. But in technologies concerning use of hydrogen as an energy source such as fuel cell, transportation of hydrogen is necessary, and therefore mechanical elements for transportation become necessary inevitably. A typical example is a compressor, in which such tribological elements as a rolling bearing and a sliding bearing are used. Consequently, countermeasure against the hydrogen embrittlement for those mechanical elements and metal materials is important, but currently little countermeasure has been taken.

Meanwhile also in the field of rolling bearings for automobile electrical and auxiliary devices, the hydrogen embrittlement has been a problem for long, and to cope with the problem the properties of grease used for them have been improved. For example, it has been proposed to add a passivation oxidant in the grease to inhibit the catalyst activity of the fresh surface created by wear by oxidizing the metal surface, so that hydrogen generation by decomposition of the lubricant can be inhibited (e.g. Patent Document 1). Another proposal is to use a phenyl ether-based synthetic oil as a base oil of a grease, so that hydrogen generation by decomposition of the lubricant can be inhibited (e.g. Patent Document 2). Another proposal is addition of a specific thickening agent, a passivation oxidant and an organic sulfonate to a specific base oil (e.g. Patent Document 3). It has been proposed to add an azo compound absorbing hydrogen to a grease to be filled in tribological materials or various elements and in bearings to be used in locations where water may enter easily (e.g. Patent Document 4). A grease composition for a long-lasting rolling bearing has been proposed, which comprises a fluorinated polymer fluid as a base oil, polytetrafluoroethylene as a thickening agent and an electroconductive material, and which does not cause flaking by hydrogen embrittlement, even if attacked by water (e.g. Patent Document 5). All of these measures are, however, against a small amount of hydrogen generated by decomposition of grease, etc. and are neither disclosing nor indicating measures to suppress a flaking, a hydrogen embrittlement-caused fracture or a hydrogen embrittlement-caused flaking in the hydrogen existing environment, in which hydrogen is actively introduced.

[Patent Document 1] JP-A-03-210394
[Patent Document 2] JP-A-03-250094
[Patent Document 3] JP-A-05-263091
[Patent Document 4] JP-A-2002-130301
[Patent Document 5] JP-A-2002-250351

DISCLOSURE OF THE INVENTION

An object of the present invention is to provide a lubricant composition for suppressing hydrogen embrittlement-caused flaking of a metal element used in a hydrogen existing environment. More particularly, an object is to provide a lubricant composition suitable for suppressing hydrogen embrittlement-caused flaking of an element existing in a high concentration hydrogen environment, such as a rolling bearing, a sliding bearing, a gear, a ball thread, a linear guide, a linear bearing, a cam or various joints.

The present inventors have intensively studied to accomplish the above object to discover that use of a specific additive can suppress hydrogen embrittlement-caused flaking of a rolling bearing, a sliding bearing, a gear, a ball thread, a linear guide, a linear bearing, a cam, various joints, etc. in a hydrogen existing environment, thereby completing the present invention.

The present invention provides a lubricant composition described below for suppressing hydrogen embrittlement-caused flaking in a hydrogen existing environment.

1. A lubricant composition for suppressing hydrogen embrittlement-caused flaking of an element used in a hydrogen existing environment, comprising a base oil and an additive, wherein the additive is at least one selected from the group consisting of an organic sulfonate, a carboxylate, a thiocarbamate and a thiophosphoric acid ester salt.

2. The lubricant composition according to the above item 1, wherein the organic sulfonate is represented by the following general formula (1), $$[R^1—SO_3]_{n1}M^1 \quad (1)$$

wherein $R^1$ represents an alkyl group, an alkenyl group, an alkylnaphthyl group, a dialkylnaphthyl group, an alkylphenyl group and a petroleum high boiler residual group; the alkyl or alkenyl is linear or branched and has 1 to 22 carbon atoms; $M^1$ represents an alkali metal, an alkaline earth metal, zinc or an ammonium ion; and n1 represents the valence of $M^1$.

3. The lubricant composition according to the above item 1, wherein the carboxylate is represented by the following general formula (2), $$[R^2—COO]_{n2}M^2 \quad (2)$$

wherein $R^2$ represents an alkyl group, an alkenyl group, an alkylnaphthyl group, a dialkylnaphthyl group, an alkylphenyl group and a petroleum high boiler residual group; the alkyl or alkenyl is linear or branched and has 1 to 22 carbon atoms; $M^2$ represents an alkali metal, an alkaline earth metal, nickel, copper, zinc, molybdenum, bismuth or an ammonium ion; and n2 represents the valence of $M^2$.

4. The lubricant composition according to the above item 1, wherein the thiocarbamate is represented by the following general formula (3), $$[R^3R^4N—CS—S—]_{n3}M^3 \quad (3)$$

wherein $R^3$ and $R^4$ may be the same or different, and represent a hydrogen atom, a C1 to C22 alkyl or alkenyl group or a C6 to C22 aryl group, provided that $R^3$ and $R^4$ are not simultaneously hydrogen atoms; $M^3$ represents nickel, copper, zinc, molybdenum, antimony, silver, lead, tellurium, a methylene group or an ethylene group; and n3 represents the valence of $M^3$.

5. The lubricant composition according to the above item 1, wherein the thiophosphoric acid ester salt is represented by the following general formula (4), $$[(R^5O)(R^6O)—PS—S]_{n4}M^4 \quad (4)$$

wherein $R^5$ and $R^6$ may be the same or different, and represent a hydrogen atom, a C1 to C22 alkyl or alkenyl group, provided that $R^5$ and $R^6$ are not simultaneously hydrogen atoms; $M^4$ represents zinc, molybdenum or antimony; and n4 represents the valence of $M^4$.

6. The lubricant composition according to any one of the above items 1 to 5, wherein the base oil comprises mineral oil and/or synthetic oil.

7. The lubricant composition according to any one of the above items 1 to 6, further comprising a thickening agent.

8. The lubricant composition according to the above item 7, comprising 65% by mass or more of the base oil comprising mineral oil and/or synthetic oil, 35% by mass or less of the thickening agent and 1 to 20% by mass of at least one additive selected from the group consisting of an organic sulfonate, a carboxylate, a thiocarbamate and a thiophosphoric acid ester salt.

9. The lubricant composition according to any one of the above items 1 to 8, wherein the element is a rolling bearing, a sliding bearing, a gear, a ball thread, a linear guide, a linear bearing, a cam or a joint.

10. A rolling bearing, a sliding bearing, a gear, a ball thread, a linear guide, a linear bearing, a cam or a joint using the lubricant composition according to any one of the above items 1 to 9.

EFFECTS OF THE INVENTION

Since the lubricant composition of the present invention includes an organic sulfonate, a carboxylate, a thiocarbamate or a thiophosphoric acid ester salt, the lubricant composition creates a tight film on the surface of a metal such as steel to prevent penetration of hydrogen into a crack generated on the surface of a metal such as steel and into the inside of the metal, so that decrease of the mechanical strength, ductility and tenacity of a metal element due to a decarburization effect of hydrogen can be prevented and the hydrogen embrittlement-caused flaking of a metal element in a hydrogen existing environment can be suppressed.

An experiment carried out by Hoffmann, Rauls, et al. has revealed that the most important factor that affects the embrittlement caused in a hydrogen atmosphere is the purity of hydrogen gas. However the past studies have been limited to an atmosphere containing a small amount of hydrogen gradually generated by decomposition of a hydrocarbon (grease, etc.) or water. On the other hand, the present invention is based on the new findings that the hydrogen embrittlement-caused flaking of an element in a hydrogen existing environment can be remarkably inhibited or suppressed under the situation where hydrogen of 99.99% purity is actively introduced forbidding the entry of other gases.

It is believed that the high effectiveness of the lubricant composition of the present invention may be attributable to the fact that the added organic sulfonate, carboxylate, thiocarbamate or thiophosphoric acid ester salt has in the molecule a hydrophobic group, such as an alkenyl group, an alkylnaphthyl group, a dialkylnaphthyl group, an alkylphenyl group or a petroleum high boiler residual group, and a hydrophilic group, such as a sulfonate, a carboxylate, a carbamic acid or a phosphoric acid. Therefore, it is believed that an oil film layer of the base oil of the lubricant composition and an adsorbed layer with lipophilic groups on the outer side constitute a double protection layer on the element surface to prevent penetration of hydrogen, especially diffusible weakly bound hydrogen, into metal.

BEST MODE FOR CARRYING OUT THE INVENTION

The present invention will be described in more detail below.

The lubricant composition of the present invention contains at least one selected from the group consisting of an organic sulfonate, a carboxylate, a thiocarbamate and a thiophosphoric acid ester salt.

A preferable organic sulfonate is represented by the general formula (1). An organic sulfonate used according to the present invention may be any of a neutral, basic or overbasic organic sulfonate. The basic or overbasic organic sulfonate is prepared by reacting an organic sulfonate with excess of calcium carbonate and/or magnesium carbonate. Although there is no particular restriction on the base number of an organic sulfonate used according to the present invention, it is preferably from 0 to 1,000 mg KOH/g.

In the formula (1), $R^1$ represents an alkyl group, an alkenyl group, an alkylnaphthyl group, a dialkylnaphthyl group, an alkylphenyl group and a petroleum high boiler residual group, and the alkyl or the alkenyl is linear or branched and has 1 to 22, preferably 4 to 22 carbon atoms. $M^1$ represents an alkali metal, an alkaline earth metal, zinc or an ammonium ion, and n1 represents the valence of $M^1$.

Preferable specific examples include zinc dioctylnaphthalene sulfonate, calcium dioctylnaphthalene sulfonate, ammonium dioctylnaphthalene sulfonate, zinc dinonylnaphthalene sulfonate, calcium dinonylnaphthalene sulfonate, ammonium dinonylnaphthalene sulfonate, zinc didecylnaphthalene sulfonate, calcium didecylnaphthalene sulfonate, ammonium didecylnaphthalene sulfonate, zinc petroleum sulfonate, calcium petroleum sulfonate, ammonium petroleum sulfonate and overbasic calcium alkylbenzene sulfonate (Commercial product: Bryton C-400 (trade name) by Crompton Corporation). More preferable specific examples include zinc dioctylnaphthalene sulfonate, calcium dioctylnaphthalene sulfonate, zinc dinonylnaphthalene sulfonate, calcium dinonylnaphthalene sulfonate, zinc didecylnaphthalene sulfonate, calcium didecylnaphthalene sulfonate and overbasic calcium alkylbenzene sulfonate (Bryton C-400).

A preferable carboxylate is represented by the general formula (2). In the formula (2), $R^2$ represents an alkyl group, an alkenyl group, an alkylnaphthyl group, a dialkylnaphthyl group, an alkylphenyl group and a petroleum high boiler residual group and the alkyl or the alkenyl is linear or branched and has 1 to 22, preferably 4 to 22 carbon atoms. $M^2$ represents an alkali metal, an alkaline earth metal, nickel, copper, zinc, molybdenum, bismuth or an ammonium ion, and n2 represents the valence of $M^2$.

Preferable examples include an alkali metal, an alkaline earth metal, nickel, copper, zinc, molybdenum, bismuth or an ammonium salt of an alkyl carboxylic acid, an alkylnaphthalene carboxylic acid, a dibasic acid such as an alkenyl succinic acid and a naphthenic acid.

Examples of a preferable alkylnaphthalene carboxylate include ammonium octylnaphthalene carboxylate, ammonium nonylnaphthalene carboxylate, ammonium decylnaphthalene carboxylate and ammonium dodecylnaphthalene carboxylate. Especially preferable are ammonium octylnaphthalene carboxylate, ammonium nonylnaphthalene carboxylate and ammonium decylnaphthalene carboxylate.

A preferable thiocarbamate is represented by the general formula (3). In the formula (3), $R^3$ and $R^4$ may be the same or different, and represent a hydrogen atom, a C1 to C22 alkyl or alkenyl group or a C6 to C22 aryl group, provided that $R^3$ and $R^4$ are not simultaneously hydrogen atoms. $M^3$ represents nickel, copper, zinc, molybdenum, antimony, silver, lead, tellurium, a methylene group or an ethylene group and n3 represents the valence of $M^3$.

Examples of a preferable thiocarbamate include zinc thiocarbamate (ZnDTC), molybdenum thiocarbamate (MoDTC), antimony thiocarbamate (SbDTC), copper thiocarbamate (CuDTC), nickel thiocarbamate (NiDTC), silver thiocarbamate (AgDTC), cobalt thiocarbamate (CoDTC), lead thiocarbamate (PbDTC), tellurium thiocarbamate (TeDTC) and sodium dithiocarbamate (NaDTC), and further methylene bis-(dibutyl) thiocarbamate. Especially preferable are zinc thiocarbamate (ZnDTC), molybdenum thiocarbamate (MoDTC) and copper thiocarbamate (CuDTC).

Further, other example of a thiocarbamate is a molybdenum dithiocarbamate represented by the following general formula (5), $$[R^7R^8N—CS—S—]_2Mo_2O_xS_y \quad (5)$$

wherein $R^7$ and $R^8$ may be the same or different, and represent a hydrogen atom, a C1 to C22 alkyl or alkenyl group or a C6 to C22 aryl group, provided that $R^7$ and $R^8$ are not simultaneously hydrogen atoms, and x+y=4.

A preferable thiophosphoric acid ester salt is represented by the general formula (4). In the formula (4), $R^5$ and $R^6$ may be the same or different, and represent a hydrogen atom, a C1 to C22 alkyl or alkenyl group, provided that $R^5$ and $R^6$ are not simultaneously hydrogen atoms. $M^4$ represents zinc, molybdenum or antimony and n4 represents the valence of $M^4$.

Preferable examples of a thiophosphoric acid ester salt include a metal salt of thiophosphoric acid alkyl or alkenyl mono-ester, a metal salt of thiophosphoric acid alkyl or alkenyl di-ester, an ammonium salt of thiophosphoric acid alkyl or alkenyl mono-ester and an ammonium salt of thiophosphoric acid alkyl or alkenyl di-ester.

Examples of a di-thiophosphoric acid ester salt include zinc dithiophosphate (ZnDTP), molybdenum dithiophosphate (MoDTP) and antimony dithiophosphate (SbDTP).

Further, other preferable example of a thiophosphoric acid ester salt is a dithiophosphoric acid ester molybdenum salt represented by the following general formula (6), $$[(R^9O)(R^{10}O)—PS—S]_2Mo_2O_2S_2 \quad (6)$$

wherein $R^9$ and $R^{10}$ may be the same or different, and represent a hydrogen atom, a C1 to C22 alkyl or alkenyl group, provided that $R^9$ and $R^{10}$ are not simultaneously hydrogen atoms.

The lubricant composition of the present invention is liquid or semi-solid and contains preferably 65% by mass or more, more preferably 70% by mass or more of the base oil, 35% by mass or less, more preferably 30% by mass or less of the thickening agent, and 0.5 to 20 mass-% of at least one additive selected from the group consisting of an organic sulfonate, a carboxylate, a thiocarbamate and a thiophosphoric acid ester salt.

Although there are no particular restrictions on the base oil used for the lubricant composition of the present invention insofar as it is suitable for the conditions of an element to be used, a mineral oil or a synthetic oil is preferable. Usable examples include a naphthene-based mineral oil, an ester-based synthetic oil, as represented by diester or polyolester, a synthetic hydrocarbon oil, as represented by poly α-olefin or polybutene, an ether-based synthetic oil, as represented by alkyldiphenyl ether or polypropylene glycol, and other synthetic oils, such as a silicone oil and a fluorinated oil.

PAO (poly α-olefin), ADE (alkyldiphenyl ether), POE (polyolester) and a mineral oil are especially preferable.

Although there are no particular restrictions on the thickening agent used for the lubricant composition of the present invention, a metal soap, such as a Li soap, a complex metal soap, such as a Li complex soap, diurea, such as aromatic diurea, organic clay, silica and polytetrafluoroethylene (PTFE) may be exemplified.

The lubricant composition of the present invention is especially suitable for lubricating elements of apparatus used in a high purity hydrogen environment. Examples of such apparatus include a fuel cell-related device, a petroleum refinery-related device, such as a heavy oil hydrocracking apparatus, a hydrodesulfurization apparatus and a hydroforming apparatus, a device related to a hydrogenation apparatus for chemicals, a nuclear power generator-related device, a hydrogen filling station for a fuel cell car and a hydrogen infrastructure-related device. Examples of metal elements used in such apparatus include a rolling bearing, a sliding bearing, a gear, a ball thread, a linear guide, a linear bearing, a cam and various joints.

Examples of materials for the elements subject to hydrogen embrittlement-caused flaking include metal materials subject to hydrogen embrittlement, such as iron and various types of steel, carbon steel and alloy steel.

Examples of a form of the lubricant composition of the present invention include, but not limited to, a lubricating oil, a grease, a sealing oil, a hydraulic oil and an anticorrosive oil.

To the lubricant composition of the present invention include, various additives may be added according to need. Examples of such additives include an antioxidant, an anticorrosive, a metal corrosion inhibitor, an oiliness improver, an antiwear agent, an extreme pressure agent and a solid lubricant.

The present invention will now be described in more detail by way of examples thereof, provided that the examples should not be interpreted in any restrictive way, and that all variations without departing from the spirit of the present invention are included in the technical scope of the present invention.

EXAMPLES

The lubricant compositions of Examples 1 to 17 and Comparative Examples 1 to 6 were prepared using the components shown in Tables 1 to 4 and the properties thereof were evaluated by the test methods described hereinbelow. The results are shown in Tables 1 to 4.

Base oil 1: PAO400 (poly α-olefin; kinematic viscosity at 40° C.: 380 to 430 $mm^2/s$)

Base oil 2: PAO100 (poly α-olefin; kinematic viscosity at 40° C.: 90 to 110 $mm^2/s$)

Base oil 3: ADE100 (alkyldiphenyl ether; kinematic viscosity at 40° C.: 95 to 105 $mm^2/s$)

Base oil 4: POE100 (polyol ester; kinematic viscosity at 40° C.: 93 to 103 $mm^2/s$)

Base oil 5: MO100 (mineral oil; kinematic viscosity at 40° C.: 90 to 110 $mm^2/s$)

Additives

A: Zn dinonylnaphthalene sulfonate

B: Ca dinonylnaphthalene sulfonate

C: Ca alkylbenzene sulfonate (overbasic Ca sulfonate; base number: about 400 mg KOH/g)

D: ammonium dinonylnaphthalene sulfonate

E: thiocarbamate (ZnDTC)

F: thiocarbamate (MoDTC)

G: thiocarbamate (SbDTC)

H: thiocarbamate (methylene(bis-dibutyl) DTC)

I: thiophosphoric acid ester salt (ZnDTP)

J: thiophosphoric acid ester salt (MoDTP)

K: Ba dinonylnaphthalene sulfonate

Thickening Agent a diurea compound prepared from diphenylmethane diisocyanate and p-toluidine 1. Evaluation Test Method (1) Test Summary Three steel balls for a bearing with the diameter of 15 mm are placed in a container with the inner diameter of 40 mm and the height of 14 mm, and about 20 mL of a test oil is filled therein. A steel ball for a bearing with the diameter of ⅝ inch is placed on the top as a rotating ball and the assembly is set on the testing machine. Running-in is conducted by rotating under load for 4 hours and then hydrogen gas is fed into the test oil thereby the 3 lower balls rotate while revolving, which are continued until flaking occurs. The flaking occurs between balls, which receive the highest contact pressure. The life is defined as the total number of contacts by the upper ball until flaking occurs. The tests are repeated 5 times, and $L_{50}$ life (a mean value of the numbers at which 50% of the same has reached the life) is determined.

(2) Test Conditions

Testing steel balls: steel balls with 15 mm diameter and a steel ball with a ⅝ inch diameter for a bearing Testing load (W): 250 kgf (5.6 GPa)

Rotation speed (n): 1,500 rpm

Hydrogen feed rate: 15 mL/min

Hydrogen purity: 99.99%

Test pressure: 0.96 atm (due to venting under a reduced pressure)

Number of tests repeated 5

2. Results of Evaluation Tests

TABLE 1

| | Example No. | | | | | | | | |
|---|---|---|---|---|---|---|---|---|---|
| | 1 | 2 | 3 | 4 | 5 | 6 | 7 | 8 | 9 |
| Base oil (% by mass) | 1 95.0 | 1 96.0 | 1 95.6 | 1 96.0 | 1 98.0 | 1 90.0 | 1 78.0 | 2 95.0 | .3 95.0 |
| Additive (% by mass) | A 5.0 | B 4.0 | C 4.4 | D 4.0 | A 2.0 | A 10.0 | A 5.0 | A 5.0 | A 5.0 |
| Thickening agent (% by mass) | none | none | none | none | none | none | 17.0 | none | none |
| Test with 4 rotating balls $L_{50}$ life ($\times 10^6$) | 76 | 70 | 68 | 65 | 51 | 88 | 81 | 32 | 38 |

TABLE 2

| | Example No. | | | | | | | |
|---|---|---|---|---|---|---|---|---|
| | 10 | 11 | 12 | 13 | 14 | 15 | 16 | 17 |
| Base oil (% by mass) | 4 95.0 | 5 95.0 | 1 98.0 | 1 97.0 | 1 98.0 | 1 96.0 | 1 98.0 | 1 96.0 |
| Additive (% by mass) | A 5.0 | A 5.0 | E 2.0 | F 3.0 | G 2.0 | H 4.0 | I 2.0 | J 4.0 |
| Thickening agent (% by mass) | none | none | none | none | none | none | none | none |
| Test with 4 rotating balls $L_{50}$ life ($\times 10^6$) | 33 | 35 | 34 | 30 | 75 | 62 | 76 | 51 |

TABLE 3

| | Comparative Example No. | | | | | |
|---|---|---|---|---|---|---|
| | 1 | 2 | 3 | 4 | 5 | 6 |
| Base oil (% by mass) | 1 100 | 2 100 | 3 100 | 4 100 | 5 100 | 1 83.0 |
| Additive (% by mass) | none | none | none | none | none | none |
| Thickening agent (% by mass) | none | none | none | none | none | 17.0 |

TABLE 3-continued

| | Comparative Example No. | | | | | |
|---|---|---|---|---|---|---|
| | 1 | 2 | 3 | 4 | 5 | 6 |
| Test with 4 rotating balls $L_{50}$ life ($\times 10^6$) | 6.4 | 3.4 | 3.8 | 3.2 | 2.9 | 9.9 |

What is claimed is:

1. A method for suppressing hydrogen embrittlement-caused flaking of an element, comprising lubricating the element with a lubricant composition in a hydrogen existing environment, in which hydrogen is actively introduced, wherein the lubricant composition comprising a base oil and 2 to 20% by mass of an additive, wherein the additive is at least one selected from the group consisting of zinc dioctylnaphthalene sulfonate, and zinc didecylnaphthalene sulfonate.

2. The method according to claim 1, wherein the base oil comprises mineral oil and/or synthetic oil.

3. The method according to claim 1, wherein the base oil further comprises a thickening agent.

4. The method according to claim 3, wherein the base oil comprises 65% by mass or more of the base oil comprising mineral oil and/or synthetic oil, 35% by mass or less of the thickening agent and 2 to 20% by mass of the additive.

5. The method according to claim 1, wherein the element is a rolling bearing, a sliding bearing, a gear, a ball thread, a linear guide, a linear bearing, a cam or a joint.

6. A method for suppressing hydrogen embrittlement-caused flaking of an element, comprising lubricating the element with a lubricant composition, wherein the element is an element of a fuel cell-related device, a petroleum refinery-related device, a device related to a hydrogenation apparatus for chemicals, a nuclear power generator-related device, a hydrogen filling station for a fuel cell car or a hydrogen infrastructure-related device, and the lubricant composition comprising a base oil and 2 to 20% by mass of an additive, wherein the additive is at least one selected from the group consisting of zinc dioctylnaphthalene sulfonate, and zinc didecylnaphthalene sulfonate.

7. The method according to claim 1, wherein the base oil is selected from the group consisting of PAO (poly a-olefin), ADE (alkyldiphenyl ether), and POE (polyolester).

8. The method according to claim 3, wherein the thickening agent is selected from the group consisting of a metal soap, a complex metal soap, and diurea.

* * * * *